United States Patent [19]

Maynard

[11] 4,239,442

[45] Dec. 16, 1980

[54] APPARATUS FOR MANEUVERING A CONDITIONING TOOL WITHIN A FURNACE

[75] Inventor: James J. Maynard, Marcellus, N.Y.

[73] Assignee: Syracuse Supply Company, Syracuse, N.Y.

[21] Appl. No.: 32,370

[22] Filed: Apr. 23, 1979

[51] Int. Cl.[3] ..... F27D 3/15

[52] U.S. Cl. ..... 414/587; 266/228; 414/718; 414/720; 414/742

[58] Field of Search ..... 414/198, 214, 215, 586, 414/587, 688, 696, 718, 719, 720, 722, 727, 742, 680, 685, 686; 173/43; 182/19, 68; 212/58 R, 59 R, 55; 266/228, 287; 299/36; 264/30

[56] References Cited

U.S. PATENT DOCUMENTS

| | | | |
|---|---|---|---|
| 2,372,220 | 3/1945 | Mork | 414/742 X |
| 3,217,900 | 11/1965 | Kupetzky et al. | 414/742 |
| 3,712,601 | 1/1973 | Brown | 266/228 |
| 3,913,756 | 10/1975 | Barron et al. | 414/718 X |

*Primary Examiner*—James L. Rowland
*Attorney, Agent, or Firm*—Bruns & Jenney

[57] ABSTRACT

Apparatus for manipulating a tool for conditioning material within a high temperature furnace. The tool is secured in one end of an air-cooled boom while the other end of the boom is connected to a carriage that is arranged to move reciprocally within a horizontally-aligned gantry. The gantry, in turn, is adjustably supported upon a chassis mounted turntable that is capable of being driven over the ground by means of a pair of endless treads. The gantry is connected to the turntable by hydraulic lifters which independently raise or lower the gantry at two separate locations along its length to impart an expanded degree of maneuverability to the tool. Shock absorber means are also operatively associated with the boom to prevent the boom structure from being damaged in the event the tool becomes hung up in the furnace.

16 Claims, 16 Drawing Figures

APPARATUS FOR MANEUVERING A CONDITIONING TOOL WITHIN A FURNACE

BACKGROUND OF THE INVENTION

This invention relates to apparatus for manipulating a material conditioning tool within a high temperature furnace and, in particular, to apparatus that is capable quickly and accurately of maneuvering a conditioning tool within a relatively large, high temperature furnace.

Some newer furnaces that are now in operation, and many of those being planned for use in the future, for reclaiming scrap material utilize a relatively large melting pit which can save a good deal of energy in certain reclaiming processes. In one such process, the entire roof of the furnace is rolled back and the scrap is deposited directly into the melting pit from an overhead crane or conveyor. The roof is quickly closed before too much energy is lost from the furnace. A conditioning tool is passed into the furnace through a comparatively small access door to evenly distribute the scrap over the pit as it is being melted. Once melted, the conditioning tool is again called upon to skim slag from the top of the liquid metal prior to its being drawn from the furnace and a new load of scrap being charged therein.

As can be seen, the conditioning tool used to service these large furnaces must be afforded a great deal of maneuverability so that it can reach all parts of the furnace through the small access opening. Furthermore the tool must be able to carry out the conditioning operation in a minimum amount of time in order to reduce the amount of heat lost through the access door and to shorten the time that the tool and the associated support equipment is exposed to the high furnace temperatures.

The most pertinent are known to the applicant at the time of filling this application is embodied in the following U.S. Pat. Nos.:

1,021,710; 3,913,756;
1,349,176; 3,931,898;
3,712,601; 3,960,285;
3,883,124; 4,045,923.

Although all these prior art devices work quite well in carrying out the specific tasks for which they were designed, they all nevertheless fail to deliver the speed and the maneuverability required to manipulate a skimming and material handling tool within a relatively large high temperature furnace.

SUMMARY OF THE INVENTION

It is therefore an object of the present invention to improve apparatus for maneuvering a tool within a furnace.

A further object of the present invention is to improve the mobility of apparatus for handling a tool within a relatively large melting furnace.

A still further object of the present invention is to shorten the time that material handling equipment is exposed to high temperatures within a melting furnace.

Another object of the present invention is to extend the useful life of equipment used to handle materials in high temperature furnaces.

Yet another object of the present invention is to provide apparatus capable of rapidly conditioning materials contained within a large metal reclaiming furnace through a relatively small access door.

These and other objects of the present invention are attained by means of a chassis mounted on treads that includes a turntable that adjustably supports a horizontally-aligned gantry in which an elongated boom is mounted for reciprocal movement upon a carriage. A conditioning tool is secured in the distal end of the boom whereby the tool can be extended and retracted into a furnace as the carriage is reciprocated within the gantry. The gantry is connected to the turntable by hydraulically actuated lifters which can independently raise and lower the gantry at two separate actuating locations along the length of the gantry to impart an expanded degree of mobility to the tool. A rigid link is pivotably mounted at one end at one of the actuating locations and at the other end in the turntable and serves to prevent lateral movement of the gantry upon the turntable and controls the vertical response of the gantry as it is being independently raised and lowered about the actuating locations.

BRIEF DESCRIPTION OF THE DRAWINGS

For a better understanding of these and other objects of the present invention reference is had to the following detailed description of the invention which is to be read in conjunction with the accompanying drawings, wherein.

DESCRIPTION OF THE INVENTION

Referring initially to FIGS. 1–7 there is shown apparatus generally referenced 10 embodying the teachings of the present invention that is capable of imparting an extended degree of maneuverability to a tool for conditioning material contained within a high temperature furnace of the type used to reclaim scrap. As will become apparent from the present disclosure, this added degree of mobility permits the conditioning tool to more easily reach all regions of a relatively large furnace and carry out the desired conditioning task in a very rapid and efficient manner. For purposes of this disclosure, a conditioning task will mean any skimming or material handling duty that is normally required to be carried out within a melting furnace of the type herein described. As noted, increased mobility reduces the amount of time the tool must be positioned in the furnace and thus leads to longer equipment life and a conservation of energy.

Figure 2:
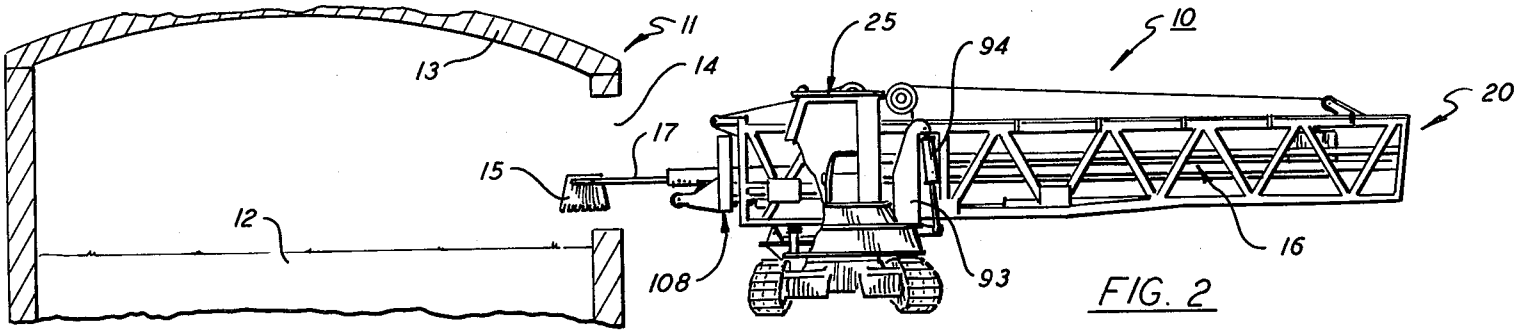
FIGS. 2–4 are side elevations of the apparatus shown in FIG. 1 illustrating an elongated tool supporting boom passing through the access door of a high temperature furnace with the tool being advanced to various lengths within the furnace.
Figure 3:
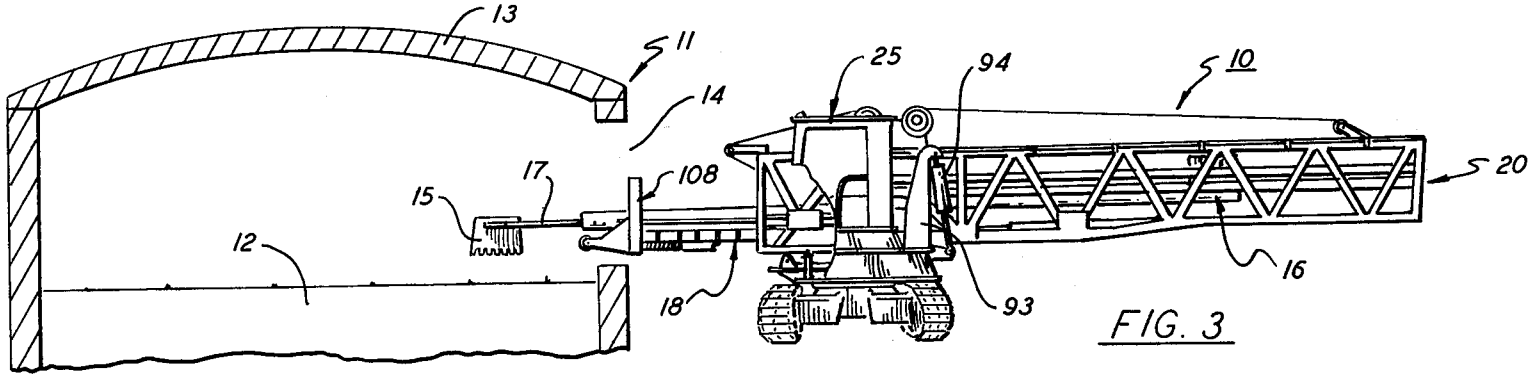
Figure 4:
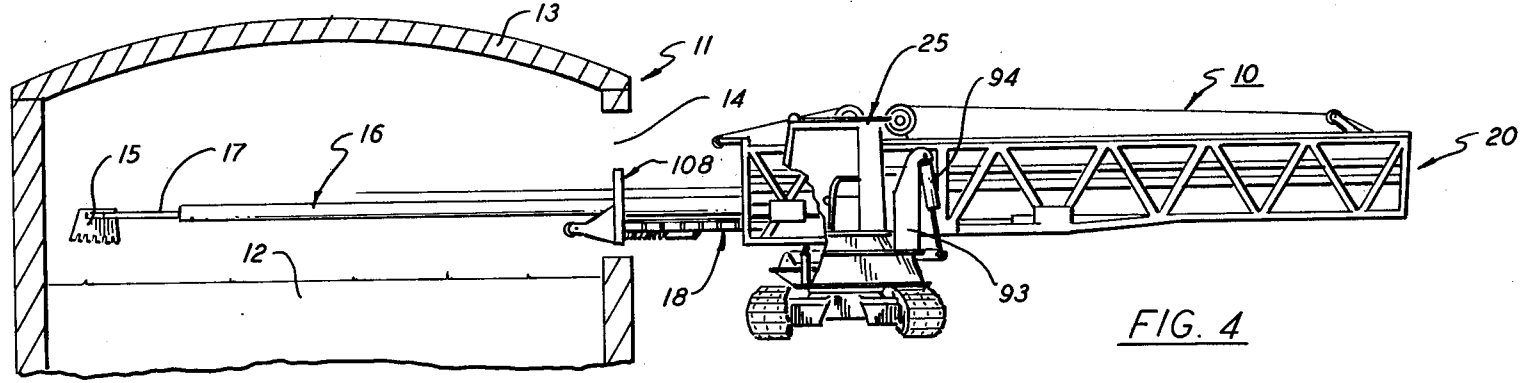

In FIGS. 2–4, the present apparatus is shown positioned before the access door of a reclaiming furnace 11 for processing aluminum scrap. The apparatus is provided with treads so that it can be conveniently moved between work stations whereby a number of furnaces may be serviced by a single piece of equipment. For purposes of this disclosure, the furnace 11 contains a circular melting pit 12, of relatively large diameter. The roof section 13 of the furnace is capable of being rolled back to permit the scrap material to be dumped into the pit from an overhead bucket or conveyor. An access opening 14 including an insulated door is located at the front of the furnace through which a conditioning tool 15 is passed to either skim slag from the pit or redistribute the scrap deposited in the pit to promote more efficient melting thereof.

Figure 1:
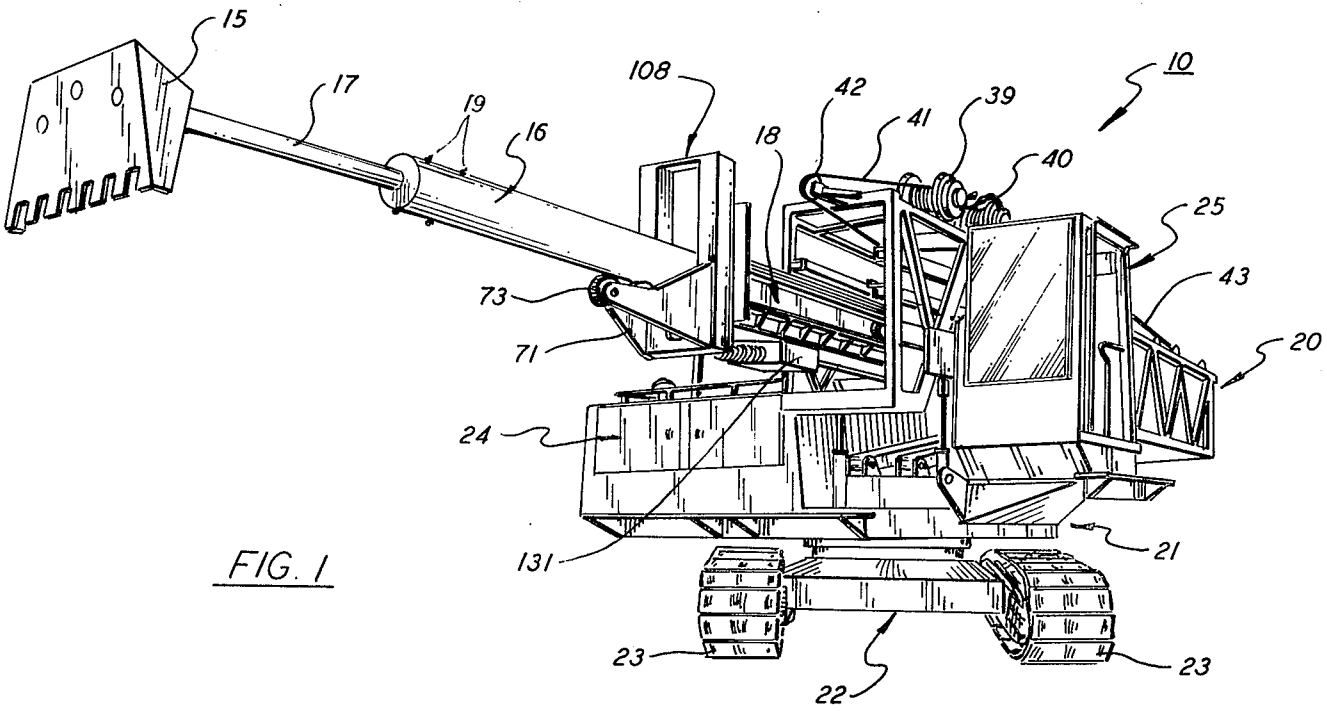
FIG. 1 is a perspective view of apparatus embodying the teachings of the present invention for maneuvering a conditioning tool within a high temperature furnace.

As best seen in FIG. 1, the conditioning tool 15 is secured in the distal end of an elongated boom 16 by locking the handle 17 of the tool to the boom structure using locking bolts 19—19. As will be explained in greater detail below, the proximal end of the boom is slung beneath a carriage 27 (FIG. 15) that rides back and forth upon rail within the confines of a horizontally aligned gantry 20. The main body of the boom rests with a cradle 18 also movably supported in the gantry forward of the carriage. The gantry is adjustably supported upon a gear-driven turntable 21 that is arranged to turn in a generally horizontal plane through 360° of rotation on a chassis 22. The chassis is furnished with a pair of conventional endless treads 23—23 whereby the entire piece of equipment can be freely propelled over the ground to more accurately position the tool within a furnace or to transport the equipment between various work stations.

The front end of the gantry is vertically aligned at about the forward edge of the turntable with the main body of the gantry extending outwardly some distance from the rear edge thereof. A drive housing 24 is mounted upon the turntable to one side of the gantry which protects an internal combustion engine for providing power to the drive treads as well as the turntable gear system (not shown). Also enclosed within the housing are one or more pumps for providing hydraulic fluid under pressure to a number of hydraulic components used to drive various systems contained in the present apparatus. A cab 25 is also mounted upon the turntable adjacent to the drive housing which contains the controls by which the operator can maneuver the conditioning tool. The cab is furnished with a forward-facing transparent heat shield designed to protect the operator from high furnace temperatures while at the same time affording an unimpeded view of the conditioning tool.

Figure 10:
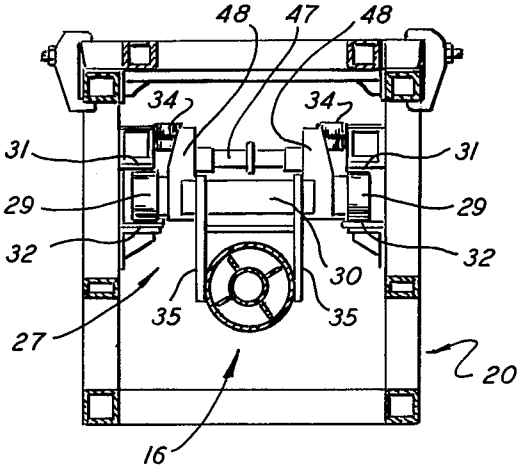
FIG. 10 is a section taken along lines 10—10 in FIG. 8 illustrating the boom suspended beneath a carriage that is movably mounted within the gantry.
Figure 14:
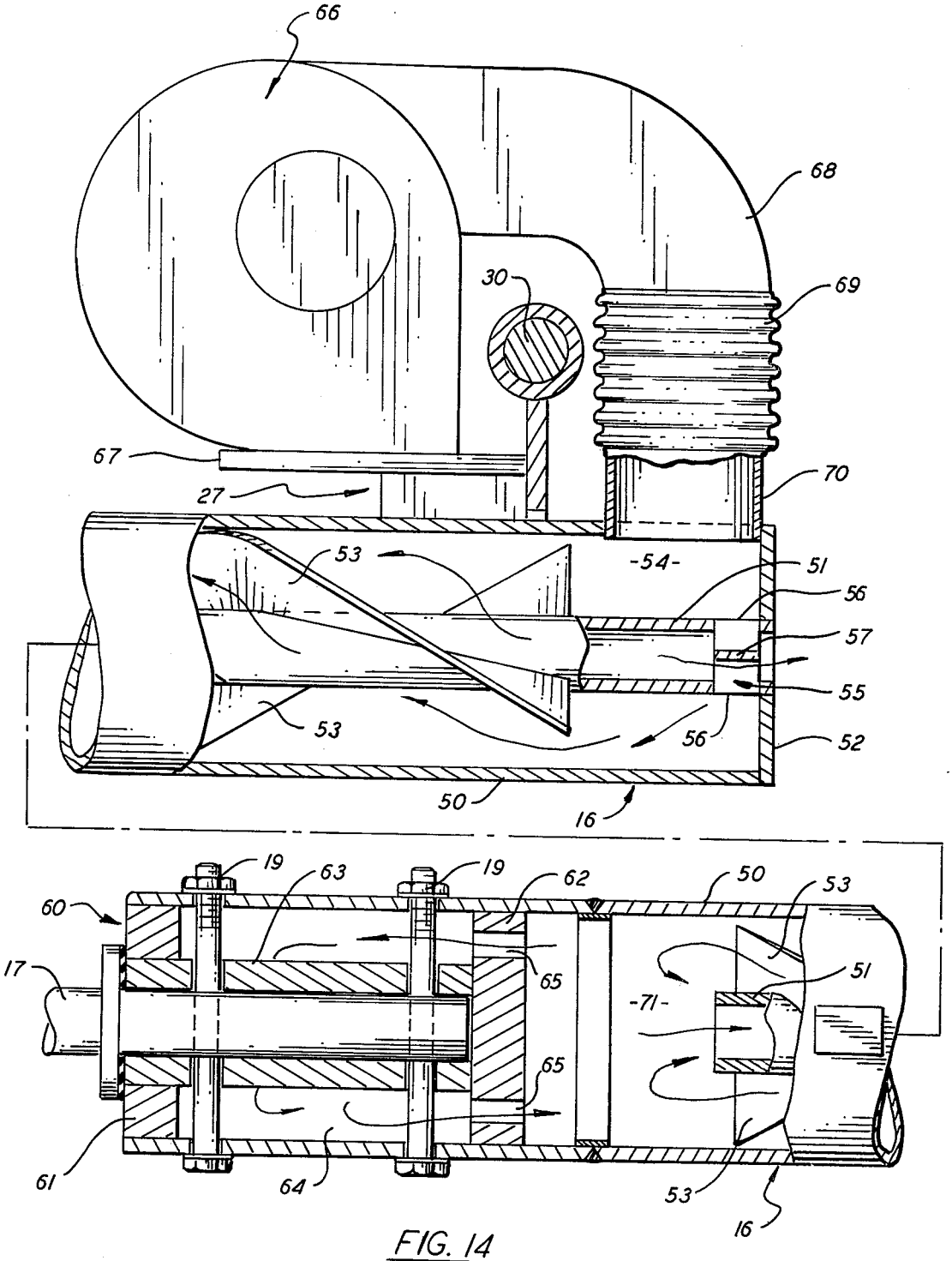
FIG. 14 is an enlarged section taken through the boom showing both the proximal end and the distal end thereof in greater detail.
Figure 15:
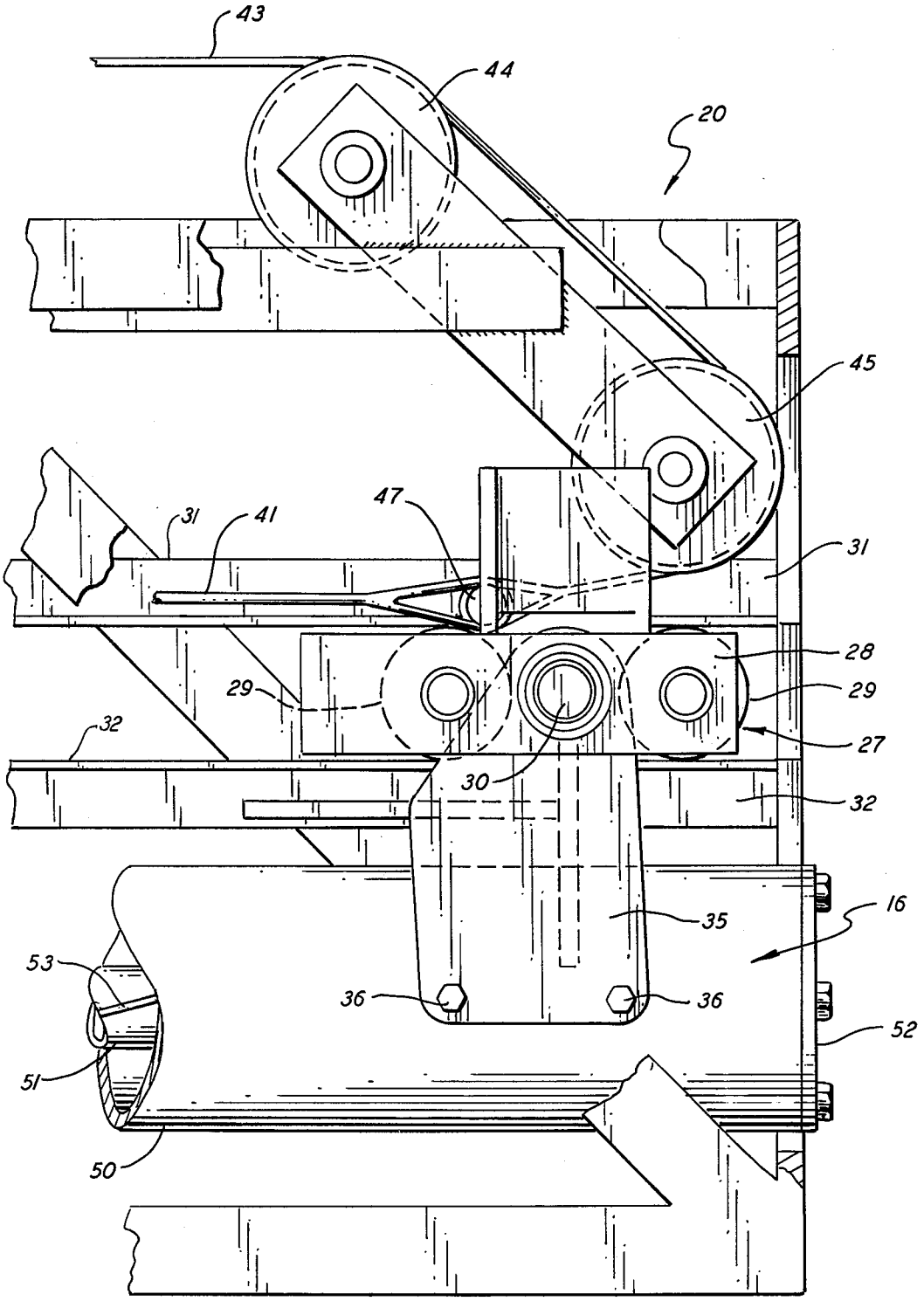
FIG. 15 is an enlarged side view showing the carriage and means associated therewith for pivotably supporting the proximal end of the boom beneath the carriage.

The gantry is fabricated from a plurality of structural elements that are brought together by welding and/or bolting to create a bridge-like section in which the boom is movably supported. With further reference to FIGS. 10, 14 and 15, the boom is suspended beneath a carriage 27 which is adapted to ride along longitudinally extended rails secured to the sidewalls of the gantry. The carriage includes two opposed bogie plates 28—28 in which a pair of wheels 29—29 are journalled for rotation. A horizontal pivot 30 is secured in each bogie plate between the wheels which, among other things, maintains lateral spacing between the wheel pairs. As best seen in FIG. 10, each wheel pair rides between an upper guide rail 31 and a lower guide rail 32. In practice, the rails are angle irons welded to the inside sidewalls of the gantry to present a horizontally turned leg to the carriage wheels. Side rollers 34 are provided to prevent lateral displacement of the carriage within the gantry as the carriage moves back and forth over the rails.

The boom is suspended below the carriage by means of side hangers 35—35 pivotably mounted upon the pivot and secured to the proximal end of the boom by means of bolts 36—36 (FIG. 15). Suitable bearing means are provided to allow the boom to freely swing about the pivot in a generally vertical plane. The importance of this feature will become apparent from the disclosure below.

The carriage is moved back and forth over the rails by means of a pair of coacting hydraulically operated winches 39 and 40 (FIG. 1) mounted atop the gantry directly over the turntable. Forward winch 39 is connected to the carriage via a cable 41 that is brought around forward pulley 42 and passed rewardly into the open front of the gantry. Rear winch 40 is connected to the carriage by a second cable 43 arranged to pass over two cooperating rear pulleys 44 and 45 (FIG. 15) which direct the cable inwardly through the rear of the gantry. The ends of both cables are secured to a raised bar 47 that is mounted above the pivot between two upraised elements 48—48. The winches are adapted to work in concert to pull the carriage, and thus the tool boom supported therebeneath, back and forth along the rails thus enabling the tool mounted in the distal end of the boom to be moved rapidly into and out of the furnace as shown in FIGS. 2–4.

Boom 16 includes an elongated outer cylinder 50 in which is contained a smaller diameter inner cylinder 51. The length of the inner cylinder is slightly less than that of the outer cylinder. An end wall 52 is secured, as for example by bolts, to the proximal end of the boom and contains a centrally located hole through which one end of the inner cylinder is allowed to pass. A plurality of radially extended fins 53—53 are spirally wrapped about the outer surface of the inner cylinder so that the fins substantially span the air space 54 provided between the two cylinders. The wrapped fins establish a plurality of spiral passageways extending along the axial length of the smaller inner cylinder. The fins are welded to the outer wall of the smaller cylinder and act as spacers to support the two cylinders in coaxial alignment in assembly. A cruciform-shaped key 55 is also furnished to prevent the cylinders from shifting in assembly as the boom is rapidly extended or retracted. The shorter vertical legs 56 of the key are secured to the wall of the inner cylinder while the longer horizontal legs 57 pass through the inner cylinder and are secured to the wall of the outer cylinder.

At the distal or tool supporting end of the boom there is provided a tool holder assembly that is generally referenced 60 (FIG. 14). The assembly includes a cylindrical front wall 61 and a companion cylindrical rear wall 62 which are slidably received within the outer cylinder 50 of the boom. A sleeve 63 is passed inwardly through an opening provided in the front wall 61 and is abutted in perpendicular alignment against rear wall 62. The assembled components are welded in place to support the sleeve in coaxial alignment within the boom. In practice, the handle of the conditioning tool is slidably received within the sleeve so that it bottoms against the rear wall 62. The locking bolts 19—19 are then passed through suitably aligned holes to secure the handle to both the sleeve 63 and the outer cylinder 50 of the boom. A cooling chamber 64 is provided between the sleeve and the outer cylinder wall which communicates with the interior of the boom by means of a number of air ports 65—65.

Cooling air is pumped into the boom from a blower 66 that is secured to a platform 67 carried upon the boom carriage. The discharge end 68 of the blower is connected directly into the boom by means of a flexible connector 69 and an inlet pipe 70. The inlet pipe enters air space 54 at the proximal end of the boom as shown in FIG. 14. Under the influence of the blower, ambient cooling air is pumped into the air space and forced along the spiral passageway described by the vanes 53—53 toward the distal end of the boom. At the distal end of the boom the cooling air enters a plenum 71 where the flow is turned and caused to return in the opposite direction through the inside of the inner cylinder. The cooling air moves along the inner cylinder in counter flow relationship with the incoming stream and is exhausted to atmosphere through the proximal end wall 52 of the boom. A portion of the cooling air that enters the plenum is passed through air ports 65 formed in the back wall of the tool holder assembly and is allowed to circulate under natural flow conditions within the cooling chamber 64. Conductive cooling of the tool holder and the tool is thus also accomplished by the air system.

The entire boom structure is rendered air tight by either securely welding the parts in assembly or providing gaskets where necessary so that the cooling air cannot inadvertently leak from the structure. Sufficient quantities of air are moved through the boom to maintain the boom temperature well below a level at which the equipment will be damaged during the period it is exposed to the high furnace temperatures. The vanes mounted within the boom serve to prevent cooling air from becoming stagnated in localized areas and thus creating "hot spots". The spiral passageways also extend the amount of time that the cooling air remains in heat transfer relationship with the boom structure thereby increasing the efficiency of the cooling system.

The forward part of the boom rests within the cradle 18 upon a support roll 73 to suspend the boom longitudinally within the gantry. The support roll is mounted beneath the boom within a bifurcated arm 72. The arm extends outwardly from the front of the cradle and normally projects beyond the front margin of the gantry as shown in FIGS. 2-6. In practice, the cradle is movably supported in the front of the gantry so that it can be reciprocally moved over a path of travel parallel to that of the carriage. Both the cradle and the carriage can be independently positioned within the gantry to change the span positions between the two boom support points thereby enabling the boom to be continually balanced within the gantry as it is either extended or retracted.

Figure 8:
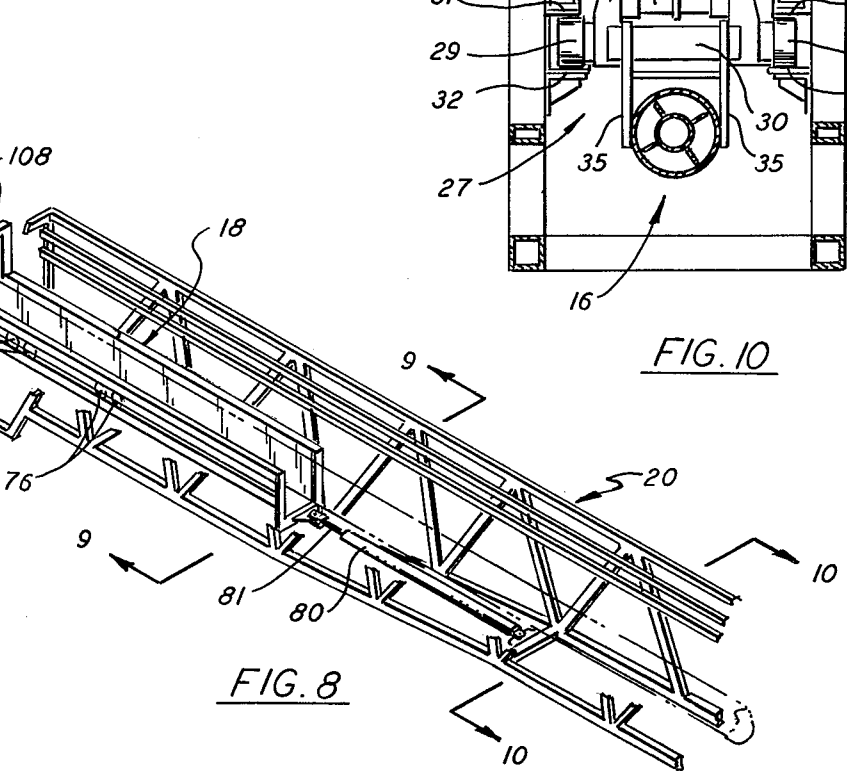
FIG. 8 is a partial perspective view of a gantry for containing the elongated boom showing a cradle for transporting the adjustable rest movably mounted in the gantry.
Figure 9:
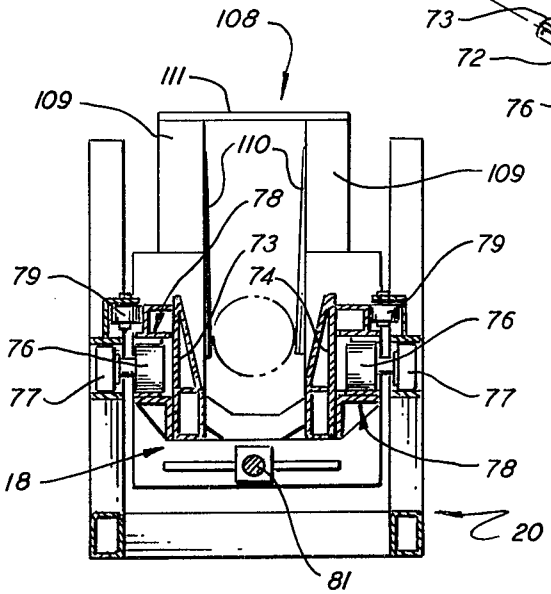
FIG. 9 is a section taken along lines 9—9 in FIG. 8 illustrating the carriage construction.
Figure 11:
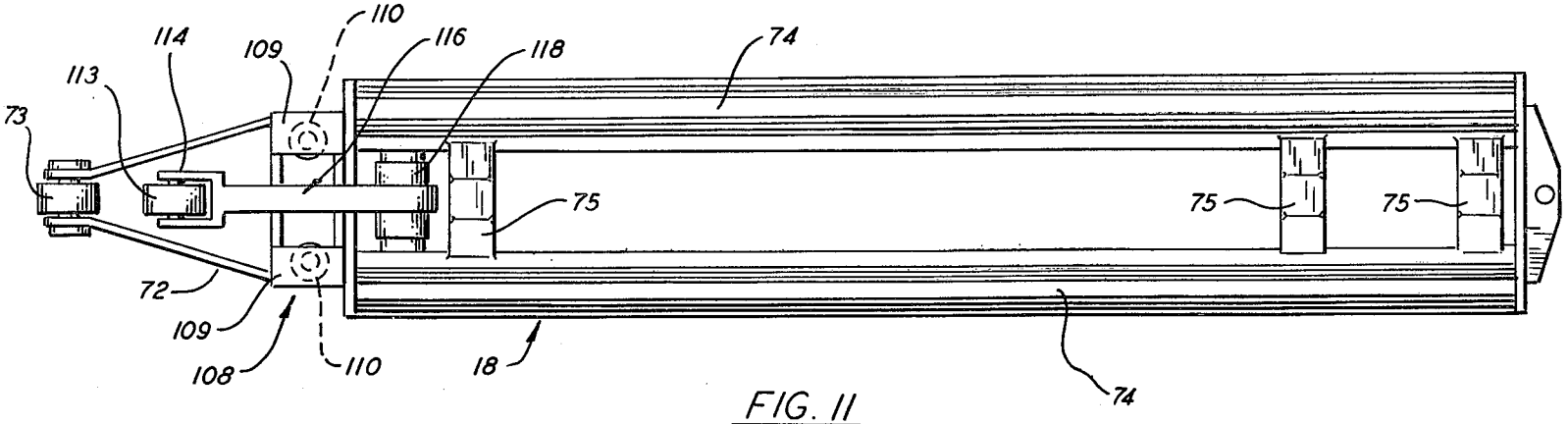
FIG. 11 is an enlarged top view of the cradle shown in FIG. 8.
Figure 13:
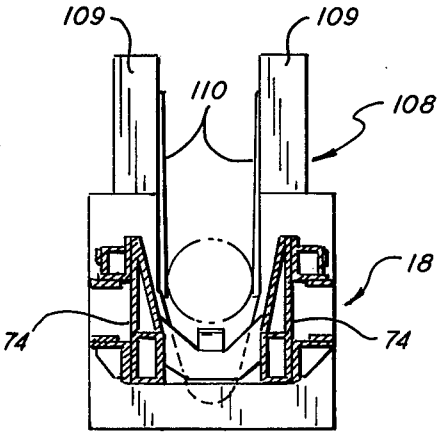
FIG. 13 is a section through the cradle taken along lines 13—13 in FIG. 12.
Figure 12:
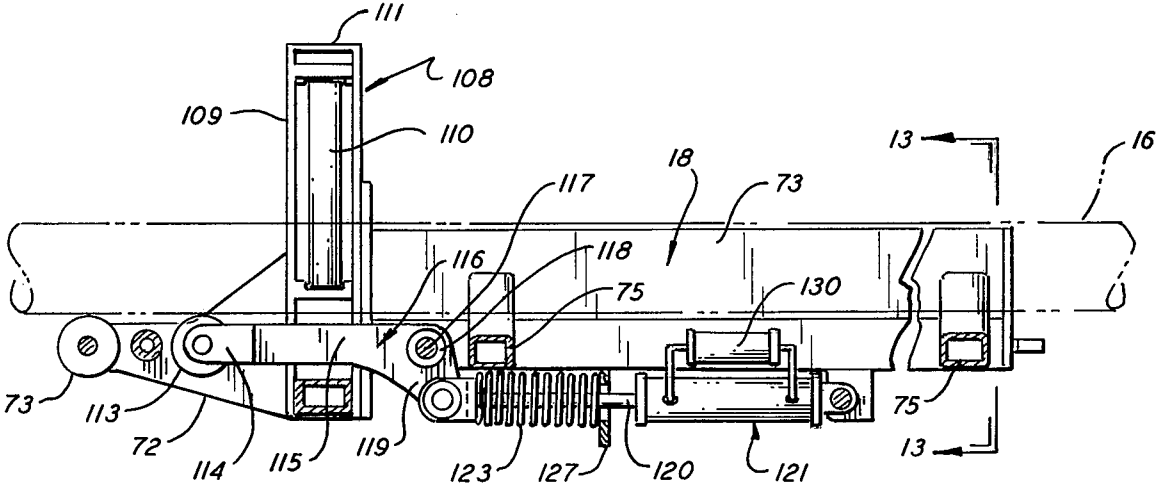
FIG. 12 is a side elevation of the cradle shown in FIG. 11 further illustrating the adjustable rest and a shock absorber unit that is arranged to act between the boom and the cradle.

As best illustrated in FIGS. 8-13, the cradle includes two sidewall members 74—74 that are cojoined by a number of laterally extended lower cross members 75—75 to form a channel-like structure that is capable of loosely housing the main body of the boom. As best seen in FIGS. 8 and 9 vertical rollers 76—76 are secured in a stationary position in the two sidewalls of the gantry by means of bearing block 77—77. The vertical rollers, in turn, are received in longitudinally extended rails 78—78 carried in the sidewalls of the cradle. Horizontally aligned side rollers 79—79 are mounted in the gantry which ride against the cradle to prevent the cradle from being laterally displaced as it moves over its prescribed path of travel. Movement of the cradle is accomplished by means of a double-acting hydraulic cylinder 80. The base of the cylinder is pivotably mounted in the bottom of the gantry while its actuating arm 81 is pivotably affixed in the rear section of the cradle so that the cradle is moved back and forth over the rollers as the arm is extended or retracted.

Figure 16:
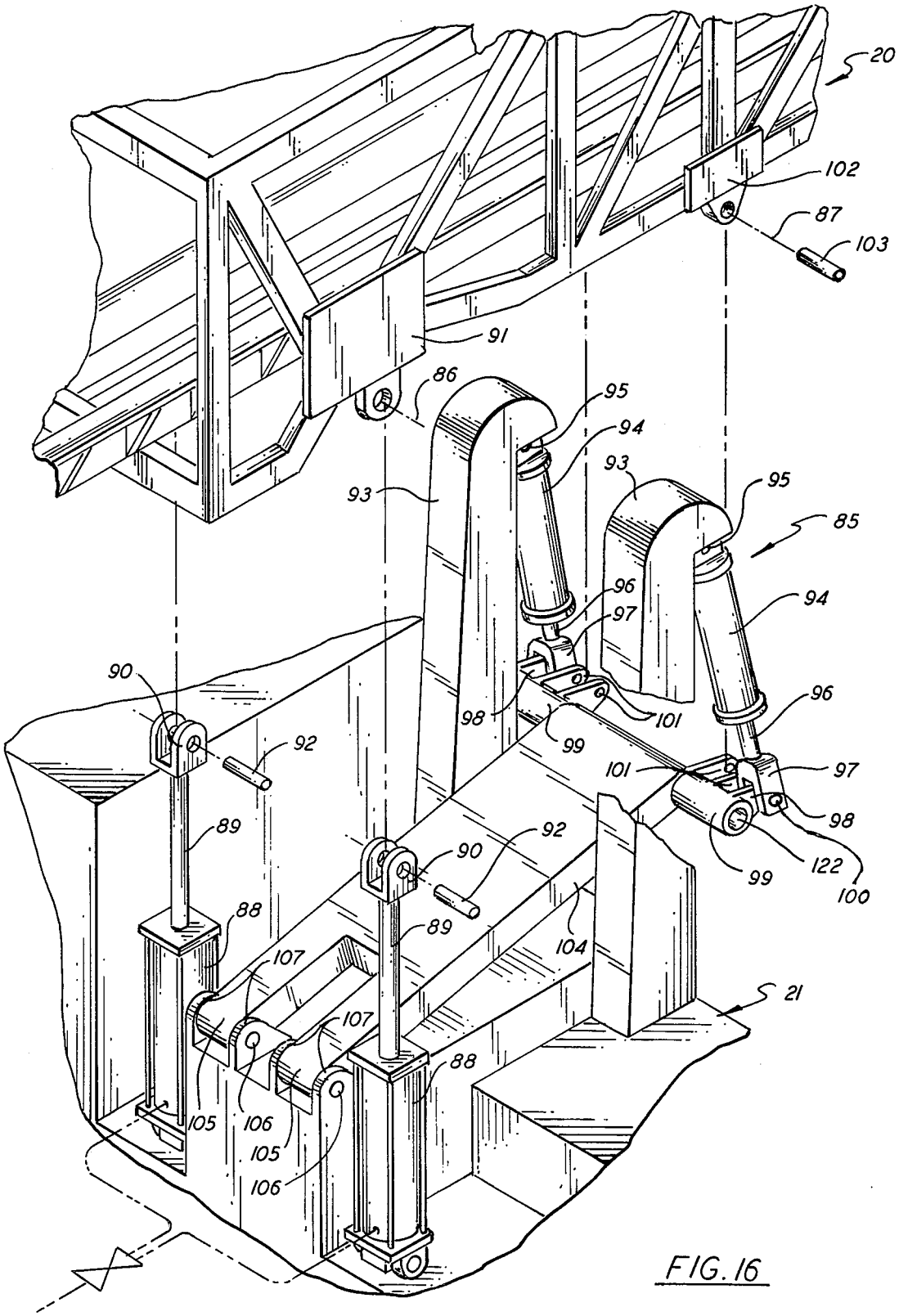
FIG. 16 is an enlarged perspective view showing hydraulic means for raising and lowering the gantry upon a turntable.

The gantry is adjustably supported upon the turntable by a hydraulically actuated lifting system that is generally designated 85. With specific reference to FIG. 16, the gantry is rotatably supported about two separate horizontal axes of rotation 86 and 87 located along the bottom surface of the gantry. The axes are spaced apart along the longitudinal length of the gantry with the front axis being generally aligned over the front edge of the turntable and the rear axis being generally aligned over the back edge of the turntable. A pair of coacting hydraulic cylinders 88—88 are seated in an upright position at the front of the turntable beneath the two vertical sidewalls of the gantry. The base of each cylinder is affixed to the turntable by any suitable means with the actuating arms 89—89 thereof extending upwardly in a vertical direction. Each actuating arm terminates with a clevis 90—90 that is secured to a connector plate 91—91 affixed to the gantry by means of clevis pins 92—92. In assembly the two clevis pins 92—92 are coaxially aligned along the front axis of rotation 86.

A pair of vertical stanchions 93—93 are affixed to the rear of the turntable and are arranged to pass upwardly adjacent to the two sidewalls of the gantry. A second pair of coacting hydraulic cylinders 94—94 are hung in an inverted posture from the stanchions by means of pins 95—95. The downwardly extended actuator arms 96—96 of the cylinders again terminate in a second set of clevises 97—97 that are rotatably connected to the outer arms 98—98 of rocker bars 99—99 by means of clevis pins 100—100. The inner arms 101—101 of each rocker bar are attached to the rear connector plates 102—102 of the gantry by means of pivot pins 103—103 that are coaxially aligned with the rear axis of rotation 87 of the gantry.

A relatively massive link 104 is rotatably supported by a shaft 122 at one end in the two rocker bars 99—99 that are connected to the rear hydraulic cylinders 94—94. The opposite or front end of the link is furnished with a pair of legs 105—105 that are rotatably secured by trunnions 106—106 in ears 107—107 vertically extended from the turntable. The link prevents the gantry from moving laterally as it is being raised and lowered upon the turntable and also regulates the longitudinal positioning of the gantry as the two axes of rotation are changed.

Figure 5:
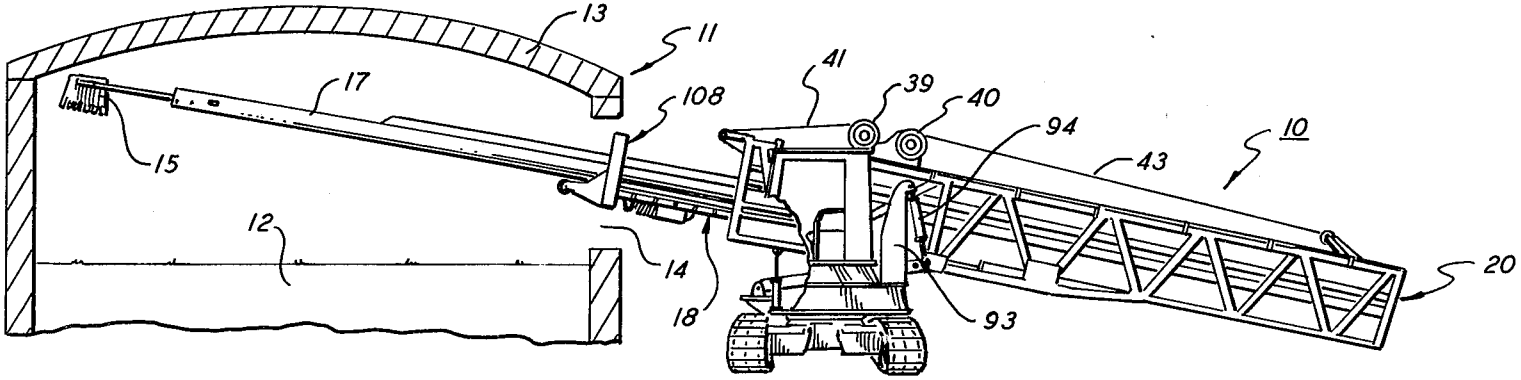
FIGS. 5 and 6 are also side elevations of the apparatus shown in FIG. 1 illustrating the tool located in each of its two extreme vertical positions.
Figure 6:
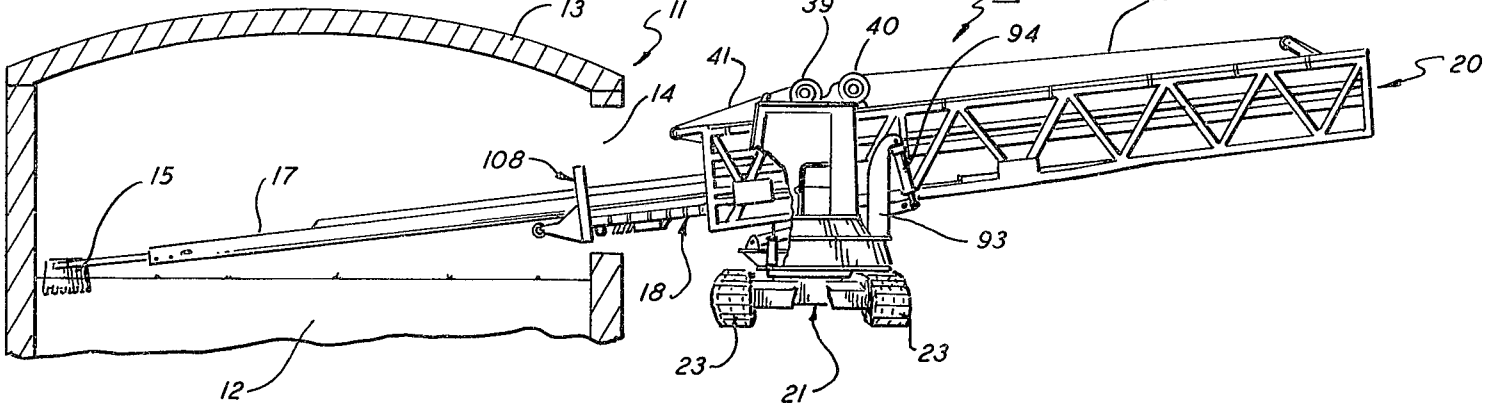
Figure 7:
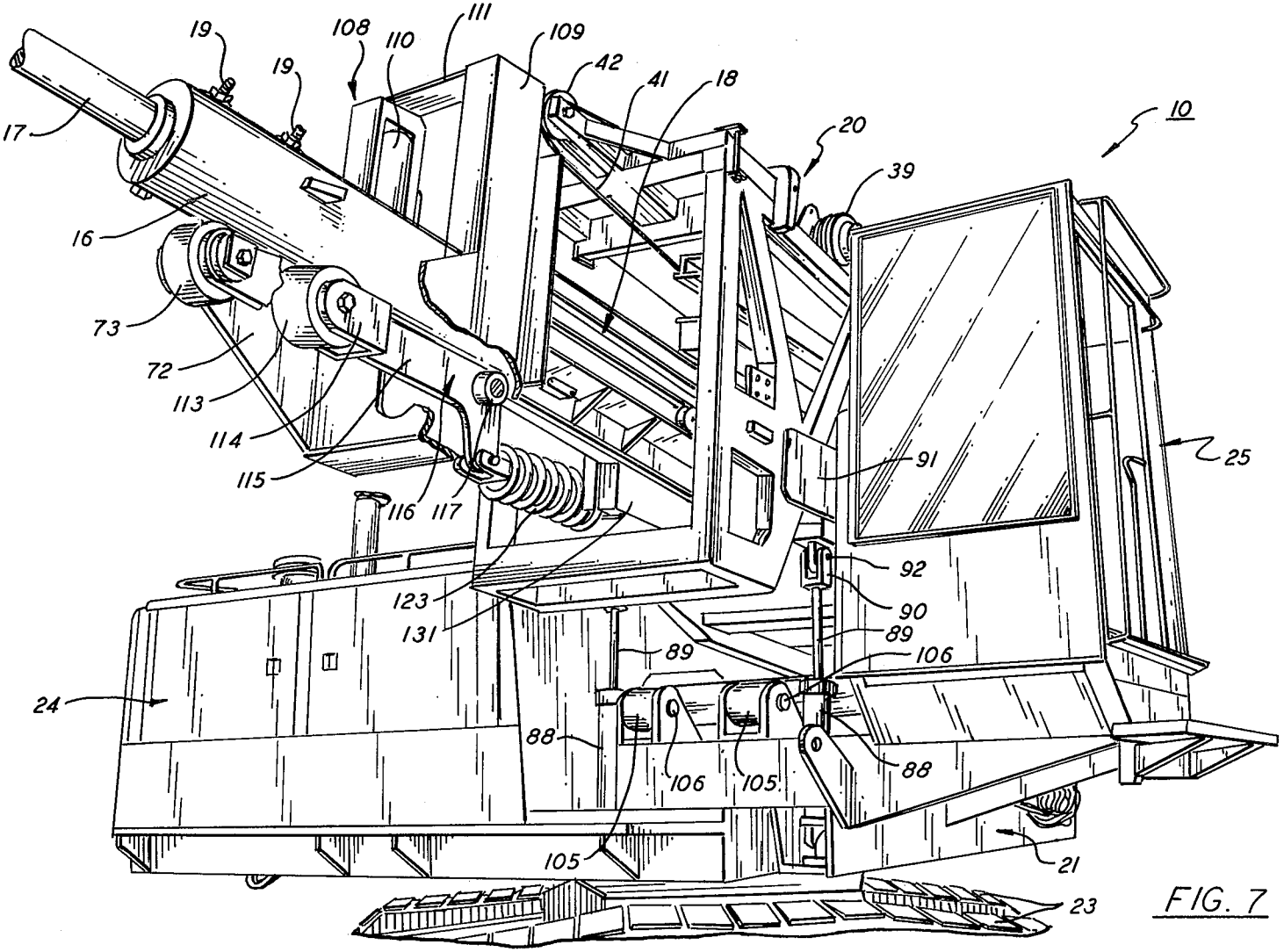
FIG. 7 is an enlarged partial perspective view of the apparatus shown in FIG. 1 further illustrating an adjustable rest for supporting the forward end of the elongated boom.

The hydraulically actuated lifting system provides a degree of maneuverability to the present equipment that has heretofore been unattainable in the art. By use of the two independently adjustable axes of rotation, the gantry can be used to bring the tool to an almost inconceivable number of different positions whereby the tool is able to reach all areas of the furnace through a relatively restrictive access opening. As illustrated in FIGS. 5 and 6, the lifting apparatus is also able to bring the tool from ground level to an extremely high elevation while still holding the gantry well balanced about the front and rear edges of the relatively wide turntable. As can be seen, if the gantry were pivotably mounted about a single pivot point on the turntable, the rotational forces about this single pivot point, particularly when the boom is in an extended position as shown, would be considerably greater than those experienced by the present equipment. As a result, the length to which the boom of the present invention can be safely extended is relatively greater than that exhibited by similar pieces of equipment known in the art.

The manner by which the boom is suspended in the gantry allows the boom to be freely raised from its forward rest provided by the support roll 73. There exists an ever-present danger that the conditioning tool can catch or hang-up upon an object inside the furnace when the operator is attempting to bring the gantry into a position to lower the elevation of the tool. Because the boom is pivotably supported in the carriage for rotation in a vertical plane, the snared boom is able to hold its position as the gantry continues to move in a downward direction. Rather than overstress the tool handling equipment, the boom is simply lifted off the cradle-mounted support roll. A yoke, generally referenced 108, is secured to the front of the cradle which includes a pair of upraised guide members 109—109 positioned adjacent to the two sidewalls of the boom resting in the cradle. Each guide member contains a cylindrical roller 110 journalled for rotation therein with the roller being adapted to ride in contact with the sides of the boom as it is longitudinally repositioned in the carriage. The guide members also serve to prevent the boom from being laterally displaced in the event it is lifted from the forward support roller 73. A top crosspiece 111 connects the two guide members and limits the amount of vertical travel afforded to the boom.

A shock absorbing system designated 112 is located beneath the cradle just behind the forward support roll. The shock absorbing system includes a boom follower roll 113 that is rotatably mounted in a frame 114 secured to the horizontal front section 115 of lever arm 116. The lever arm is pivotably mounted about a stub shaft 117 hung below the cradle in a mounting bracket 118. The downwardly turned rear section 119 of the lever arm is pinned to the extendable ram shaft 120 of shock absorber unit 121. The shock absorber unit is anchored in the cradle so as to dampen any rapid loading placed upon the follower roll by the boom. A compression spring 123 is wound about the ram shaft and is arranged to act between the lever arm and a stationary member 127 depending downwardly from the cradle. A continuous biasing force is thus exerted against the lever which urges the follower roll into contact against the bottom of the boom. The spring rate is strong enough to overcome the force of the shock absorber unit whereby the follower roll will tend to remain in contact with the boom in the event it is lifted from the forward support roll 73.

When the boom is inadvertently lifted from the support roll, the follower roll of the shock absorber system will continue to ride in contact with the boom. Typically, the boom, when hung up within the furnace, will be pulled away from the ensnaring structure by the operator retracting or otherwise repositioning the boom. Upon becoming freed, the heavy boom wants to fall back into contact with the forward support roll. However, the shock created by the sudden release of the boom is imparted to the shock absorber unit through the follower roll and lever arm whereupon the potentially harmful forces are dampened and the boom is lowered at a controlled rate onto the forward support roll. A bleed tank 130 is operatively connected to the shock absorber unit to regulate the dampening effect of the unit. A housing 131 is also placed around the unit to protect it from heat and dirt contamination.

While this invention has been described with reference to the structure disclosed herein, it is not confined to the details set forth and this application is intended to cover any modifications or changes as may come within the scope of the following claims.

I claim:

1. Apparatus for adjusting the vertical positioning of a tool support including a base frame, a generally horizontally-aligned gantry positioned over the base frame having a tool support boom movably mounted therein which extends outwardly from the front of the gantry, horizontally-aligned front and rear pivot means affixed to the gantry in a spaced-apart parallel relationship, a first adjusting means being arranged to act between the base frame and the front pivot means for raising and lowering the gantry in regard to the base frame, a second adjusting means being arranged to act between the base frame and the rear pivot means for raising and lowering the gantry in regard to the base frame, and a link being rotatably supported at one end in one of said pivot means and being rotatably supported at the other end within said base frame.

2. The apparatus of claim 1 wherein said first and second adjusting means both include hydraulically actuated cylinders that are secured at one end to the base and having extendable arms connected to the front and rear pivot means.

3. The apparatus of claim 2 wherein each of said first and second adjusting means includes a pair of hydraulic cylinders that are arranged to act between the base frame and one of said pivot means at the sidewalls of said gantry.

4. The apparatus of claim 3 wherein the first pair of cylinders is arranged to raise the gantry at the front pivot means as the actuating arms thereof are extended and the second pair of cylinders is arranged to lower the gantry at the rear pivot means as the actuating arms thereof are extended.

5. The apparatus of claim 4 which further includes a pair of vertically extended stanchions mounted upon the base frame and passing upwardly along each vertical sidewall of said gantry and having support means associated with each stanchion to hang one of said second adjusting hydraulic cylinders above said second pivot means.

6. The apparatus of claim 2 wherein the link is rotatably supported in said rear pivot means.

7. The apparatus of claim 1 that further includes control means for independently regulating the activities of said first and second adjusting means.

8. The apparatus of claim 6 that further includes a pair of trunnions mounted in the base frame for rotatably supporting the opposite end of said link to prevent the link and thus the support structure from moving laterally as the gantry is raised and lowered at said pivot means.

9. Apparatus for conditioning materials within a high temperature furnace including a chassis having tread means for propelling said chassis over the ground, a turntable rotatably supported upon the chassis whereby said turntable can rotate through 360° of travel in a generally horizontal plane, a horizontally-aligned gantry mounted upon the turntable having horizontal front and rear pivot means affixed thereto in spaced-apart parallel alignment, a first adjusting means being arranged to act between the turntable and the front pivot means for raising and lowering said gantry at said first pivot means, a second adjusting means being arranged to act between the turntable and the rear pivot means for raising and lowering said gantry at said second pivot means, a link rotatably mounted at one end in one of said pivot means and at the opposite end within said turntable, a carriage movably supported within said gantry for reciprocal travel along a longitudinal path of travel, and an elongated boom mounted at its proximal end within said carriage and having a conditioning tool secured in the distal end thereof whereby the tool is extended and retracted as said carriage moves over said path of travel.

10. The apparatus of claim 9 which further includes cooling means for moving a constant stream of cooling air through the interior of said elongated boom.

11. The apparatus of claim 10 wherein the cooling means further includes a blower that is mounted upon said platform for movement therewith.

12. The apparatus of claim 9 wherein said proximal end of said boom is pivotably supported upon a horizontal pin within said carriage to permit the boom to swing about the pivot in a vertical plane and further includes a forward rest mounted within a cradle for supporting the bottom of the boom at some point between said proximal and distal ends thereof.

13. The apparatus of claim 12 wherein said cradle is also movably mounted within said gantry whereby the position of said forward rest may be adjusted.

14. The apparatus of claim 13 wherein the forward rest is a roller that is adapted to move along the boom surface of the boom.

15. The apparatus of claim 12 further including shock absorber means secured to said cradle for engaging the lower surface of the boom, said shock absorber being capable of lowering said boom at a controlled rate in the event the boom is lifted upwardly from said forward rest.

16. The apparatus of claim 15 wherein said shock absorber further includes a second roller operatively connected therewith that is arranged to ride in contact against the bottom surface of said boom and further includes a biasing means for independently urging said second roller into continuous contact with the boom regardless of the vertical position of said boom in regard to said cradle.

* * * * *